US006308333B1

(12) United States Patent
Jackson

(10) Patent No.: US 6,308,333 B1
(45) Date of Patent: Oct. 30, 2001

(54) DISPOSABLE BIB

(76) Inventor: Valarie D. Jackson, 4639 Quachita St., Houston, TX (US) 77039

( * ) Notice: Subject to any disclaimer, the term of this patent is extended or adjusted under 35 U.S.C. 154(b) by 0 days.

(21) Appl. No.: 09/547,146

(22) Filed: Apr. 11, 2000

(51) Int. Cl.[7] ..... A41B 13/10
(52) U.S. Cl. ..... 2/49.4; 2/49.1
(58) Field of Search ..... 2/49.1, 49.2, 49.4, 2/49.5, 50, 51, 52, 48, 46

(56) References Cited

U.S. PATENT DOCUMENTS

| | | | | |
|---|---|---|---|---|
| H1738 | * | 7/1998 | Reinhart, Jr. | 2/49.1 |
| 797,434 | * | 8/1905 | Homeyer | 2/49.4 |
| 2,571,888 | * | 10/1951 | Jesse | 2/49 |
| 2,838,758 | * | 6/1958 | Townley | 2/49 |
| 3,286,279 | * | 11/1966 | Brown | 2/49 |
| 4,186,443 | * | 2/1980 | Britzman | 2/49 R |
| 4,884,299 | * | 12/1989 | Rose | 2/49 R |
| 5,490,289 | * | 2/1996 | Lehrer | 2/49.2 |
| 5,802,610 | * | 9/1998 | Burr | 2/49.4 |
| 6,070,268 | * | 6/2000 | Holland | 2/49.4 |

* cited by examiner

*Primary Examiner*—Amy B. Vanatta
(74) *Attorney, Agent, or Firm*—Kenneth D. Baugh

(57) ABSTRACT

A disposable bib 10 is provided. The bib 10 includes an upper member 14 and a first absorbent member 18 coupled to the upper member 14. The disposable bib 10 also includes a second absorbent member 20 which is coupled to the first absorbent member 18. A water resistant member 22 is coupled to the second absorbent member 20. A first multilayer bib arm 24 is coupled to an upper portion of one side of the upper member 14 first and second absorbent members 18 and 20 and water-resistant member 22. A second multilayer bib arm 26 is spaced from the first multilayer bib arm 24 and coupled to an upper portion of another side of the upper member 14 first and second absorbent members 18 and 20 and water-resistant member 22 so that an opening is formed therebetween thereby allowing the bib 10 to be supported around a user's neck.

12 Claims, 2 Drawing Sheets

DISPOSABLE BIB

TECHNICAL FIELD

This invention relates to a bib and more particularly to a disposable bib for protecting a user and the user's garments from liquids and/or food which may fall onto the user while engaging in activities such as eating and drinking. Cleanliness is an ongoing concern because of the health consequences associated therewith. Cleanliness is of particular concern when infants, young children and even adults in some instances eat or drink or engage in activities wherein unwanted liquids and/or food stuffs can get onto their clothes. One of the more common solutions to minimize these kinds of unsanitary conditions is a bib designed to be placed around a user's neck to protect designated areas of the user's body and clothing.

BACKGROUND ART

Infants, young children and even adults in certain circumstances often have a need to wear bibs. The bib provides protection for their clothing which may result from spills that may occur from activities such as eating and/or drinking.

There are a number of different bib arrangements in existence today. Some of the bib arrangements are nondisposable thereby requiring that they be washed after use. Having to wash a bib after use is undesirable because this can be a time consuming chore. This provides for additional work. There are also disposable bibs. The disposable bibs are desirable because they are simply disposed of after use and no additional work is required. Although the disposable bibs don't have to be washed after use, because of the disposable nature of the materials from which they are made of, there is always a concern as to whether they will provide adequate absorption and protection for the user.

One bib arrangement for protecting a user's clothing is disclosed in U.S. Pat. No. 4,733,411. In this arrangement an outer absorbent paper layer and an inner water proof plastic layer is provided. Each layer is configured to provide an apron and a yoke and are bonded together in overlapping relationship with adhesive and connected along their outer boundaries with stitching. Because this arrangement only has two layers, adequate absorption may not be facilitated, thus adequate protection for the user may not be achievable.

Another arrangement is disclosed in U.S. Pat. No. 4,811,428. In this patent a bib is fabricated of a thermally bonded laminate of vinyl film and polyester fabric materials. This bib is washable and disposable. Because of the materials used, the absorption qualities of the bib may be enhanced. However the materials used in this bib arrangement would appear to make it costly and would not make it the most desirable candidate as a disposable unit. What is desirable is a disposable bib which provides maximum absorption qualities and protection for the user while still being cost effective.

DISCLOSURE OF THE INVENTION

A disposable bib is provided for protecting a user from moisture and other undesirable debris. The disposable bib of this invention includes an upper planar shaped member having a plurality of spaced aligned openings formed therein. A first absorbent planar shaped member is aligned with and coupled to the upper member. The disposable bib also includes a second absorbent planar shaped member which is aligned with and coupled to the first absorbent member. A water resistant planar shaped member is aligned with and coupled to the second absorbent member. A first elongated bib support member is coupled to one upper outermost portion of the upper member, first and second absorbent members and water resistant member. A second elongated bib support member which is spaced from the first elongated bib support member is coupled to another upper outermost portion of the upper member, first and second absorbent members and the water resistant member. This permits an opening to exist between the bib support members so that the bib can be supported around a user's neck.

BRIEF DESCRIPTION OF THE DRAWING

The details of the invention will be described in connection with the accompanying drawing in which.

BEST MODE FOR CARRYING OUT THE INVENTION

Figure 1:
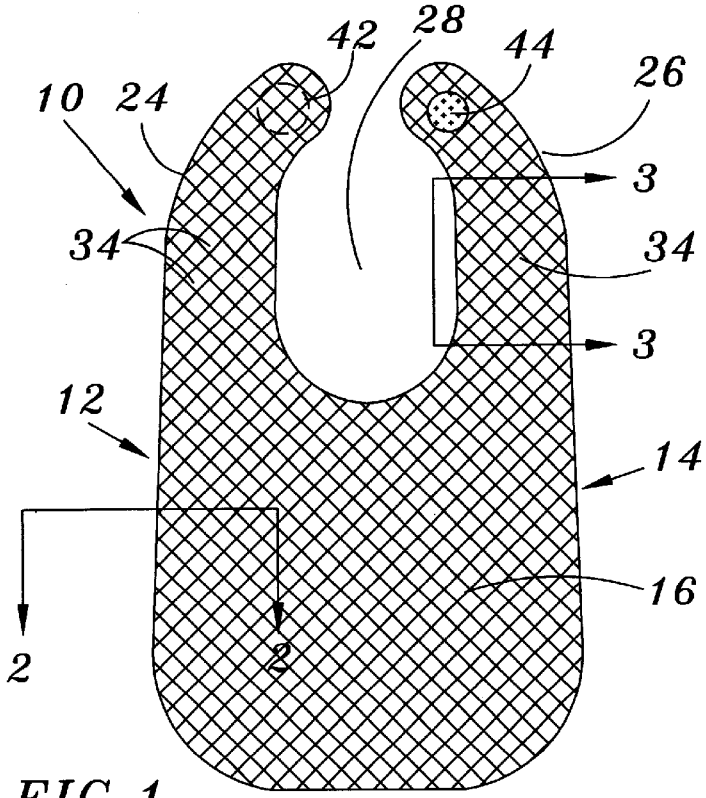
FIG. 1 is a plain view illustrating a disposable bib in accordance with the principles of the invention.
Figure 2:
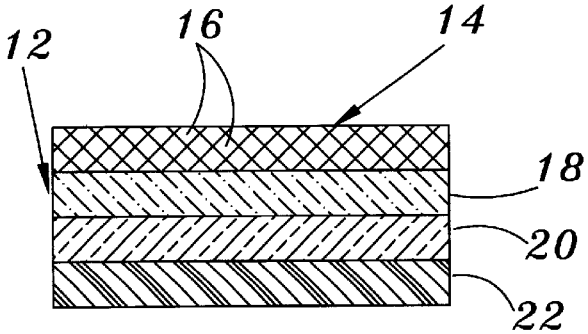
FIG. 2 is a horizontal cross-sectional view taken along line 2—2 of FIG. 1.

Referring to FIGS. 1 and 2 there is shown, a disposable bib, generally designated by the numeral 10. The bib 10 includes a planar shaped base member, generally designated, by the numeral, 12 (FIG. 2). The base member 12 is provided with an upper member, generally designated, by the numeral 14 having a plurality of apertures 16 formed therein. The upper member 14, can be made, for example, of a thin plastic mesh like material which will allow liquid like substances to flow therethrough.

The base member 12 of the bib 10 also includes a first planar shaped absorbent member 18 which is adjacently aligned with and coupled to the upper member 14. The absorbent member 18 is provided to absorb moisture and liquids that flow through the apertures 16 in the upper member 14. The absorbent member 18, may be made, for example, of a thin paper-like absorbent material. A second absorbent planar shaped member 20 is aligned with and coupled to the first absorbent member 18. The second absorbent member 20 is provided to absorb any liquids that are not absorbed by and may flow through the absorbent member 18 to the absorbent member 20. The absorbent member 20, may be made, for example, of a thin cotton-like material having absorbent qualities.

The disposable bib 10 is also provided with a bottom planar shaped member 22 which is adjacently coupled to the second absorbent member 20. The bottom member 22 is water resistant and is provided to repel liquids that may flow through the second absorbent member 20. This causes liquids to be contained in the absorbent members 18 and 20 thereby keeping liquids off the user. The water resistant member 22 may be made of a thin plastic-like material. The members 14, 18, 20 and 22 are coupled together in a well known manner, such as, for example with an adhesive and may also be stitched together along the edges thereof.

The bib 10 also includes a pair of elongated support members or arms 24 and 26, respectively. The arms 24 and 26 are coupled to outermost opposite portions of the base member 12 in spaced aligned relationship so that an opening 28 is formed therebetween. The opening 28 is provided so that the arms 24 and 26 can be supported around the neck of a user (not shown) thereby allowing the bib 10 to protect the desired portion of the user's body and clothing.

Figure 3:
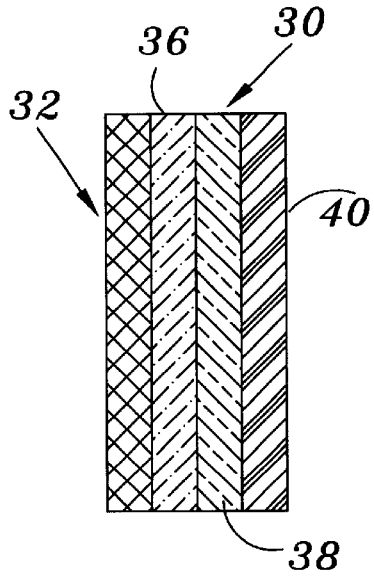
FIG. 3 is a vertical cross-sectional view taken along line 3—3 of FIG. 1.

As illustrated in FIG. 3, the arms 24 and 26, like the base member 12, each include a multilayer member, generally designated, by the numeral, 30. The member 30 includes a first layer 32 having a plurality of apertures 34, formed therein. The layer 32 of the arms 24 and 26, like the layer 14, may also be made of a plastic mesh-like material which allows liquid like substances to flow through the material. The multilayer member 30 of the arms 24 and 26 also includes a first absorbent layer 36 which is coupled to the layer 32. The first absorbent layer 36 is provided to absorb liquids that flow from the first layer 32 and may be made of a paper-like absorbent material as is the absorbent member 18. A second absorbent layer 38 is coupled to the absorbent layer 36. The absorbent layer 38 is provided to absorb any liquids that may flow from the first absorbent layer 36 The absorbent layer 38 is formed of the same material as is the absorbent member 20 and may be made, for example, of a cotton-like absorbent material as is the absorbent member 20.

The multilayer member 30 of the arms 24 and 26 is also provided with a bottom water resistant layer 40, which is aligned with and coupled to the second absorbent layer 38. The water resistant layer 40 is made of the same water resistant material as in the water resistant member 22 of the base member 12 and is provided to repel liquids that flow from the absorbent layer 38 thereby facilitating containment of liquids in the absorbent member.

As is illustrated the arms 24 and 26 are coupled to the base member 12, in a well known manner, so that layers 32, 36, 38 and 40 thereof are integrally formed with corresponding members 14, 18, 20 and 22, respectively, of the base member 12. The layers 32, 36, 38 and 40 are coupled to each other in the same manner as the members 14, 18, 20 and 22.

Figure 4:
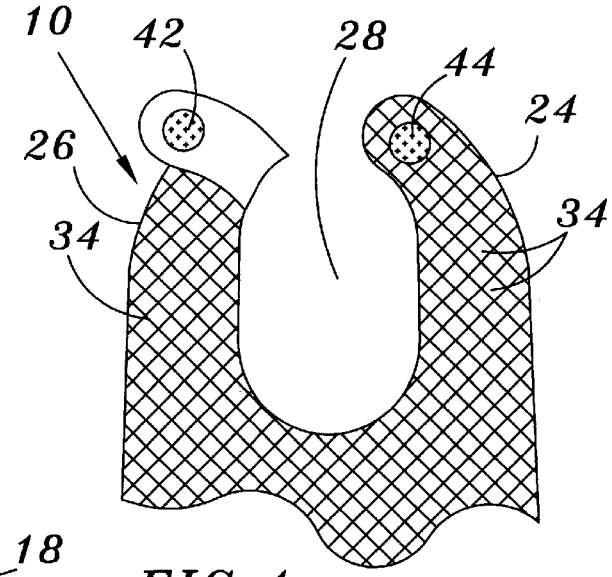
FIG. 4 is an elevated fragmentary view of a bib fastening assembly in accordance with the principles of the invention.

The arms 24 and 26 are provided with a coupling member 42 and 44 respectively (FIG. 4). The coupling members 42 and 44 are provided to be selectively engaged so that the bib 10 can be held in place around or removed from the user's neck as desired. The coupling members 42 and 44, may be made, for example, of a releasably engagable coupling material such as Velcro.

Figure 5:
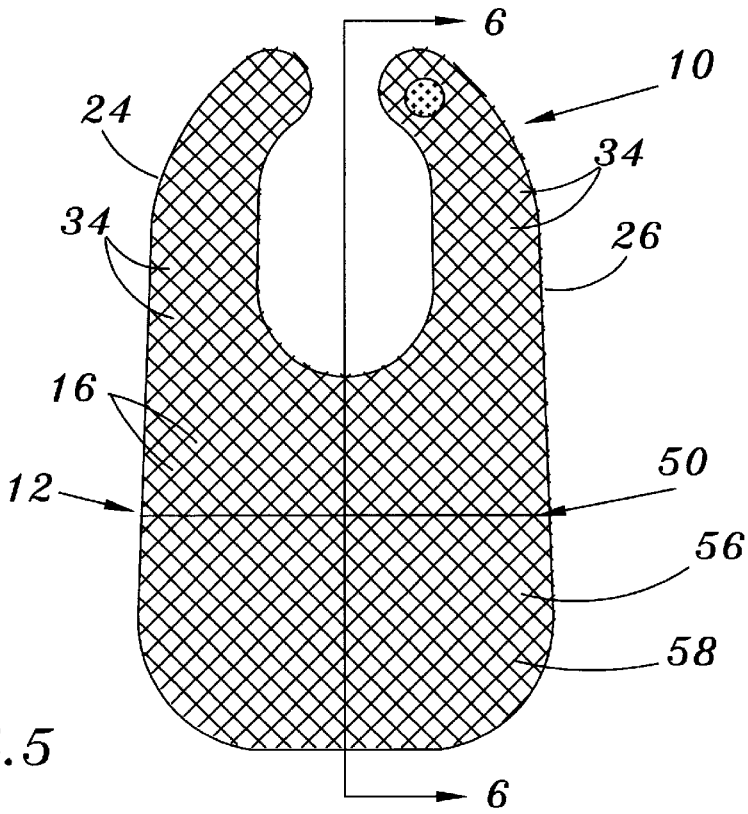
FIG. 5 is a plain view illustrating a disposable bib in accordance with the principles of the invention having a pocket formed thereon.
Figure 6:
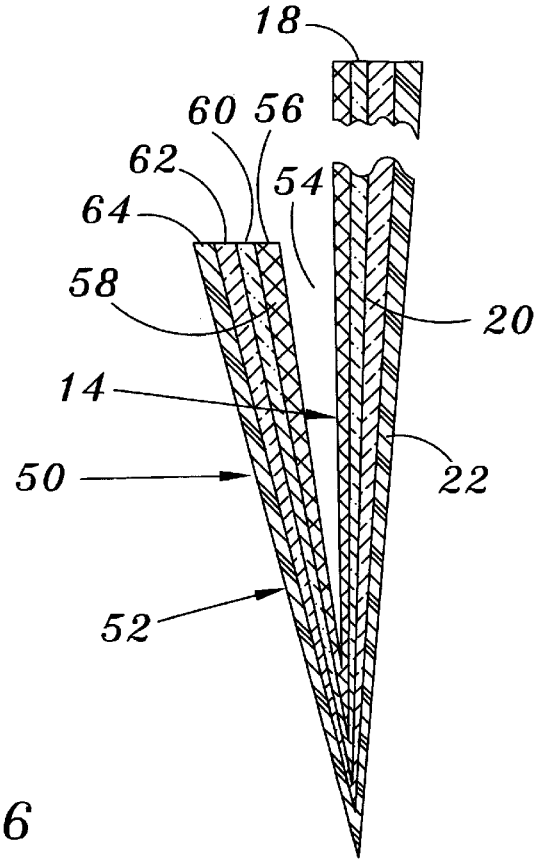
FIG. 6 is a vertical cross-sectional view taken along line 6—6 of FIG. 5.

As illustrated in FIGS. 5 and 6, the bib 10 may also be provided with a pocket, generally designated, by the numeral, 50. The pocket 50 is provided to collect any substances which may not be readily absorbable by the other portions of the bib such as food stuffs. The pocket 50 is formed of a multilayer member 52. The multilayer member 52 is spaced from and aligned with lower portions of the base member 12 thereby forming a cavity 54 therebetween. The cavity 54 is provided to catch any substances that may fall onto the bib that are not absorbed into the bib.

The multilayer member 52 is formed of a layer 56 having apertures 58 formed therein and absorbent layers 60 and 62 and a water resistant layer 64. The layers 56, 60, 62 and 64 function just as do the members 14, 18, 20 and 22, respectively, of the base member 12 and may be made of the same materials.

When it is desired to use the bib 10 a user can simply couple the bib 10 around the neck so that the bib 10 is secure. This allows the user and the user's clothing to be protected from any excess liquid or other substances that may fall onto the bib.

The invention has been shown and described in what is considered to be the most practical and preferred embodiment. However, it should be recognized that changes may be made by those skilled in the art without departing from the spirit of the invention.

What is claimed is:

1. A disposable bib including:

upper planar shaped member having a plurality of shaped aligned openings formed therein including a thin plastic mesh material which allows liquid like substances to flow therethrough;

first absorbent planar shaped member coupled to the upper planar shaped member including a thin paper absorbent material;

second absorbent planar shaped member coupled to the first absorbent member including a thin cotton material having absorbent qualities;

lower water resistant planar shaped member coupled to the second absorbent member including a thin plastic material;

a first elongated multilayer bib support member coupled to one outermost upper portion of the upper, first and second absorbent, and lower planar shaped members;

a second elongated multilayer bib support member spaced from the first elongated bib support member and coupled to a second outermost upper portion of the upper, first and second absorbent and lower planar shaped members so that the first and second elongated bib support members have an opening formed therebetween and so that the first and second elongated bib support members can be supported around a user's neck, the first and second elongated multilayer bib support members each including, an upper layer having a plurality of apertures formed therein;

a first absorbent layer coupled to the upper layer;

a second absorbent layer coupled to the first absorbent layer; and a lower water resistant layer coupled to the second absorbent layer.

2. A disposable bib as defined in claim 1 wherein the first and second elongated multilayer bib support members each include a coupling member formed thereon for selectively engaging each other to hold the bib in a preselected designated place.

3. A disposable bib as defined in claim 2 wherein the upper layer of the bib support members include a thin plastic mesh-like material.

4. A disposable bib as defined in claim 3 wherein the first absorbent layer of the bib support members include a thin paper-like material.

5. A disposable bib as defined in claim 4 wherein the second absorbent layer of the bib support members include a thin cotton-like material having absorbent qualities.

6. A disposable bib as defined in claim 5 wherein the lower water-resistant layer of the bib support members include a thin plastic-like material.

7. A disposable bib as defined in claim 6 further including a pocket member.

8. A disposable bib as defined in claim 7 wherein the pocket member includes:

an upper layer having a plurality of spaced aligned apertures formed therein, the upper layer being aligned with and spaced from lower portions of the upper member so that a cavity is formed therebetween;

a first absorbent member coupled to the upper layer;

a second absorbent layer coupled to the first absorbent layer; and a lower water-resistant member coupled to the second absorbent member.

9. A disposable bib as defined in claim 8 wherein the upper layer of the pocket member is formed of a thin plastic mesh-like material.

10. A disposable bib as defined in claim 9 wherein the first absorbent member of the pocket member is formed of a thin paper absorbent material.

11. A disposable bib as defined in claim 10 wherein the second absorbent layer of the pocket member is formed of a cotton material having absorbent qualities.

12. A disposable bib as defined in claim 11 wherein the lower water resistant member of the pocket member includes a thin plastic material.

* * * * *